United States Patent [19]

Felber et al.

[11] 4,139,193

[45] Feb. 13, 1979

[54] KICK TRAINING AID FOR KARATE

[76] Inventors: David P. Felber, Rte. 2, Box 128, Manteno, Ill. 65090; Daniel M. Burrello, 203 W. Marquette Ave., Berlin, Wis. 54923

[21] Appl. No.: 841,728

[22] Filed: Oct. 13, 1977

[51] Int. Cl.[2] ..... A63B 23/04

[52] U.S. Cl. ..... 272/146

[58] Field of Search ..... 272/94, 96, 97, 76, 272/78, 145, 146, 109, 76, 96; 248/441 R, 443, 447, 451, 452, 454; 35/29 R

[56] References Cited

U.S. PATENT DOCUMENTS

| | | | |
|---|---|---|---|
| 478,166 | 7/1892 | Madsen | 272/142 |
| 1,509,793 | 9/1924 | Thompson | 272/96 |
| 1,565,484 | 12/1925 | McWhirter | 272/142 |
| 2,817,524 | 12/1957 | Sadler | 272/132 |
| 2,909,371 | 10/1959 | Alcover | 272/109 |
| 3,176,986 | 4/1965 | Posatsley | 272/132 |
| 3,352,559 | 11/1967 | Larsen | 272/142 |
| 3,372,930 | 3/1968 | Sertich | 272/96 |
| 3,768,808 | 10/1973 | Passera | 272/132 |
| 3,782,721 | 1/1974 | Passera | 272/132 |
| 3,929,329 | 12/1975 | Rivera | 272/97 |

*Primary Examiner*—Richard C. Pinkham
*Assistant Examiner*—T. Brown
*Attorney, Agent, or Firm*—Wegner, Stellman, McCord, Wiles & Wood

[57] ABSTRACT

A kick training aid for karate has a pole mounted for universal movement on a base, a foot-piece mounted for universal movement atop the pole, and straps to secure a person's foot to the foot-piece. The student is forced to kick properly, and upon completion of a kick, the side of the foot is in correct striking position. The pole is extensible for use by persons of different height, and also to increase the height to which a person is forced to kick as training progresses.

9 Claims, 4 Drawing Figures

3
13
15
3
10
2
12
24
25
14
23
11
S
l
2
25
24
25
26
27
23
12
29a
28a
28
29
14
30
21
21a
22
22a
20
20a
18
19
11
16
17
F
38a
l
f
41
37a
39
13
13
38a
38
41
39
40
35
35a
37a
36
36a
37
34
33
34a
32
15
31a
31
32a
12
24

KICK TRAINING AID FOR KARATE

BACKGROUND OF THE INVENTION

The proper practice of karate requires very extensive practice to perfect the various modes of attack; and some modes are very difficult to learn because they require body action of a character which is used for no other purpose.

Many karate students find that the karate kick is the most difficult maneuver to learn. The kick must be delivered by swinging the attacking leg up to one side of the body and striking with the side of the foot. An effective karate kick is delivered practically without bending the knee of the attacking leg; so it is a particularly awkward move for most people to learn to do right.

Heretofore the usual training technique has required that the instructor hold a student's foot in his hand while the kick is learned and practiced; although, of course, after two students have learned the essentials of a proper kick they can work together. It is very difficult for a karate student to practice kicking technique alone.

SUMMARY OF THE INVENTION

The principal object of the invention is to provide a karate kick training aid which forces a student to kick with the correct leg action and which also causes the student's foot to be in correct striking position at the end of the kick.

Another object of the invention is to provide a training aid which permits a student of karate to improve his kicking technique without the help of an instructor or another student.

Still another object of the invention is to provide a training aid which may be adjusted for use by students of different heights, and also force a particular student to kick to increasing heights as training progresses.

Yet another object of the invention is to provide a training aid which may be readily disassembled for transport from place to place.

The foregoing objects of the invention are achieved by the karate kick training aid which is hereinafter described in detail and set out in the accompanying claims.

THE DRAWINGS

DETAILED DESCRIPTION OF THE INVENTION

Figures 1, 2, 3, 4:
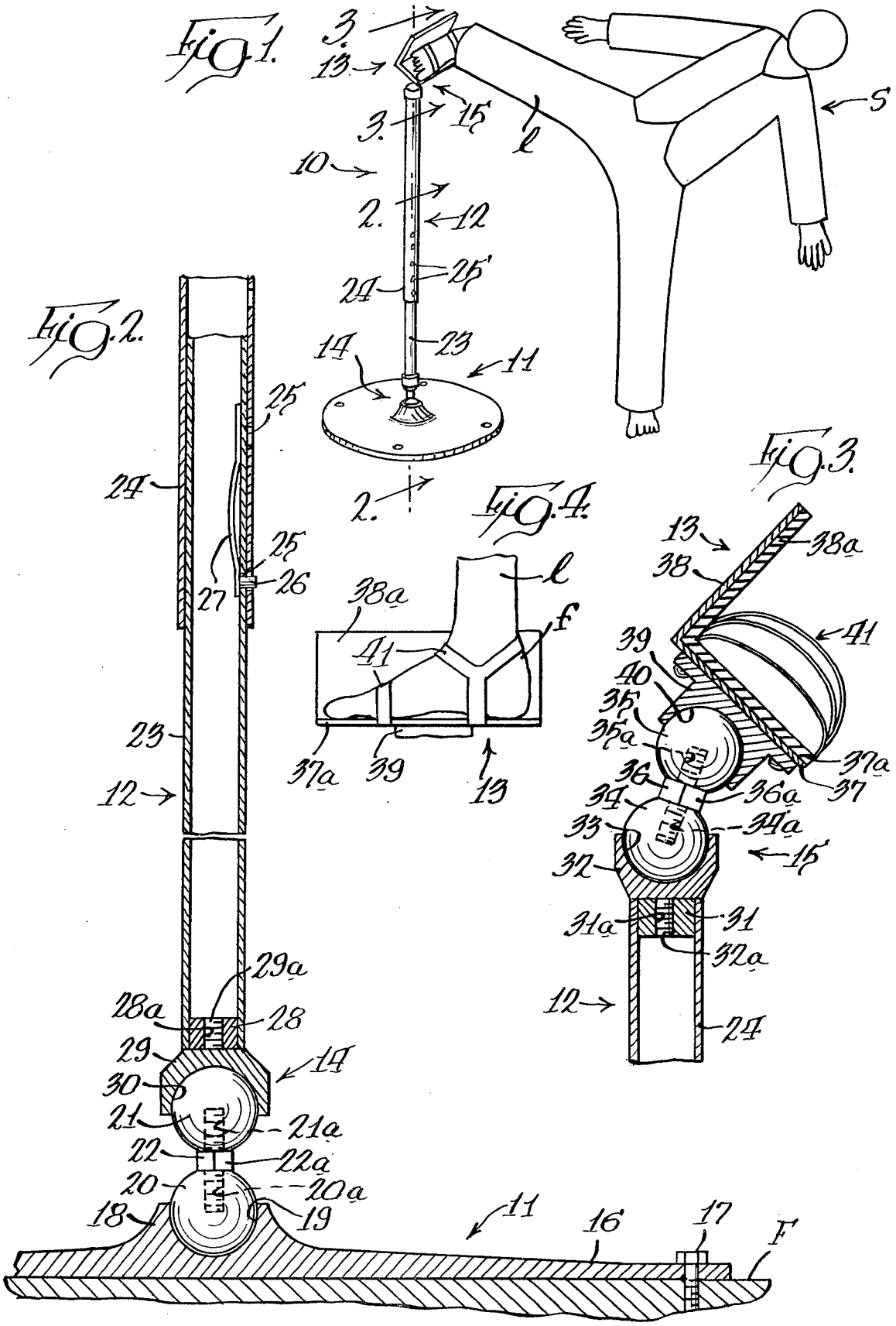
FIG. 1 is a perspective view of a training aid embodying the invention, with a person illustrated rather schematically in the position that is occupied at the completion of a kick.
FIG. 2 is a fragmentary sectional view on an enlarged scale taken substantially as indicated along the line 2—2 of FIG. 1.
FIG. 3 is a fragmentary sectional view on an enlarged scale taken substantially as indicated along the line 3—3 of FIG. 1.
FIG. 4 is a fragmentary side elevational view of the foot-piece and straps with a person's foot secured thereto in the position occupied by the foot before a kick is started.

Referring to the drawings in detail, and referring first to FIG. 1, the karate kick training aid of the present invention, indicated generally at 10, is seen to consist generally of a base, indicated generally at 11; a pole, indicated generally at 12; a foot-piece, indicated generally at 13; mounting means, indicated generally at 14, by which the pole 12 is connected to the base 11 for universal movement; and connecting means, indicated generally at 15, which mounts the foot-piece 13 on the pole for universal movement.

The base 11 consists of a large, preferably circular plate 16 which has holes adjacent its periphery to receive screws 17 by means of which it may be detachably secured to a floor F. At the center of the base plate 16 is a boss 18 having a substantially hemispherical recess 19 which provides a first socket that forms part of the mounting means 14.

The mounting means also includes a first ball 20 which is seated in the socket 19 for universal swinging and rotary movement, and the first ball 20 has a radially extending threaded, blind bore **20*a*. The mounting means 14 also includes a second ball 21 which has a radially extending, threaded blind bore 21*a*; and a threaded stud 22 with a centrally positioned hex head 22*a* screws into both the blind bores 20*a* and 21*a*** to form a stem connecting the balls to one another.

The pole 12 consists of a lower pole member 23 and an upper pole member 24 which telescopes onto the lower pole member. Any one of a series of holes 25 in the upper pole member 24 may be aligned with a lock stud 26 which is carried upon a leaf spring 27 within the lower pole member 23 so that it is biased outwardly through a hole in the side of the lower pole member and may be engaged with any one of the holes 25 so as to adjust the length of the pole 12. At the bottom of the lower pole member 23 is a plug 28 which has a threaded axial bore **28*a*; and a pole bottom fitting 29 has a threaded stem 29*a* by means of which it is connected to the plug 28. A downwardly facing effectively hemispherical second socket 30 in the bottom of the fitting 29 receives the second ball 21, and thus forms a part of the mounting means 14**.

As seen in FIG. 3, at the top of the upper pole member 24 is a plug 31 which has a threaded bore **31*a*; and a pole top fitting 32 has a threaded stud 32*a* by means of which it is secured to the plug 31. The pole top fitting 32 is provided with a third socket 33 which forms a part of the connecting means 15 for mounting the foot-piece 13; and a third ball 34 is mounted in the third socket 33 for universal swinging and rotary movement. In the third ball 34 is a radially extending, threaded blind bore 34*a*. The connecting means 15 also includes a fourth ball 35 which has a radially extending threaded blind bore 35*a*; and a threaded stud 36 which screws into the bores 34*a* and 35*a* and has an intermediate hex head 36*a*** provides a stem connecting the third and fourth balls.

The foot-piece 13 consists of a sole plate 37 and a side plade 38 at right angles to one another; and said plates have sponge rubber pads **37*a* and 38*a*, respectively, bonded to their adjacent inner faces. A boss 39 secured to the bottom of the sole plate 37 provides a fourth socket 40 which is a part of the connecting means 15 in which the fourth ball 35** is seated for universal swinging and rotary movement.

The foot-piece 13 also includes straps 41 which are generally like those of a sandal, so that a karate student, indicated generally at S, may secure a foot f to the foot-piece 13 as seen in FIG. 4.

In use, the pole 12 is first adjusted to suit both the height and the degree of expertise of the student S, and is then swung about the mounting means 14 to a position in which the pole top fitting 32 is on the floor. The connecting means 15 for the foot-piece 13 is then adjusted to bring the foot-piece sole plate 37 into a substantially horizontal position, and the student S fastens his foot f to the foot-piece as seen in FIG. 4. When the student kicks, the pole 12 forces the leg 1 to swing upwardly in the proper manner, and the universal mounting of the connecting means 15 permits the student S to have the foot f in correct striking position upon completion of the kick.

A new student may start with the pole 12 so adjusted that at the finish of a kick the striking foot f is no more than about waist high. As the student's expertise increases, the length of the pole may be adjusted so that ultimately the student is delivering a kick which terminates with his foot f as high as the height of the student when standing upright.

The foregoing detailed description is given for clearness of understanding only and no unnecessary limitations should be understood therefrom as modifications will be obvious to those skilled in the art.

We claim:

1. A kick training aid for karate comprising, in combination:

a fixed base having a top surface;

an adjustable length pole the length of which may be adjusted to approximates the height to which a person training for karate is to kick said pole having a first end and a second end;

mounting means connecting said first end of said pole to the top surface of the fixed base for universal swinging movement thereon for rotation of said pole about its longitudinal axis;

a foot-piece having a sole plate for the sole of a persons foot;

connecting means secured to said sole plate and mounting said foot-piece on said second end of said pole for universal swinging movement thereon and for rotation of said foot-piece relative to an axis perpendicular to said sole plate;

and means for detachably securing a person's foot to said foot-piece with the sole of a persons foot against said sole plate.

2. The combination of claim 1 in which said mounting means comprises a first socket surmounting said base, a first ball mounted in said first socket for universal swinging and rotary movement, and means securing said pole to said first ball.

3. The combination of claim 2 in which said means securing said pole to said first ball comprises a second socket in said first end of said pole, a second ball mounted in said second socket for universal swinging and rotational movement and a stem fixed to both of said first and second balls.

4. The combination of claim 3 in which the connecting means comprises a third socket on said second end of the pole, a third ball mounted in said third socket for universal swinging and rotary movement, and means securing the foot-piece to the third ball.

5. The combination of claim 4 in which the means securing the foot-piece comprises a fourth socket on the foot-piece, a fourth ball mounted in said fourth socket for universal swinging and rotary movement, a threaded post on said fourth ball, and a threaded hole in the third ball into which said post is screwed.

6. The combination of claim 1 in which said connecting means comprises a first ball and socket joint, and means securing said foot-piece to said ball and socket joint.

7. The combination of claim 6 in which said means securing the foot-piece comprises a second ball and socket joint on said foot-piece, a threaded post on said ball of said second ball and socket joint, and a threaded hole in said ball of said first ball and socket joint into which said post is screwed for connecting said ball and socket joints.

8. The combination of claim 7 in which said foot-piece has a padded sole plate, a padded side plate substantially perpendicular to a side of said sole plate, and straps for securing the foot of a person to the foot-piece with the sole of a person's foot against said sole plate.

9. The combination of claim 1 in which said foot-piece has a padded sole plate, a padded side plate substantially perpendicular to a side of said base plate, and straps for securing the foot of a person to the foot-piece with the sole of a person's foot against said sole plate.

* * * * *